US006947695B2

(12) United States Patent
Iida et al.

(10) Patent No.: US 6,947,695 B2
(45) Date of Patent: Sep. 20, 2005

(54) IMAGE FORMING APPARATUS INCLUDING TWO IMAGE FORMING MEMBERS AND FEATURING A DOT-SHAPED IMAGE

(75) Inventors: Kenichi Iida, Boise, ID (US); Tatsunori Ishiyama, Shizuoka (JP); Yasuo Yoda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/661,506

(22) Filed: Sep. 15, 2003

(65) Prior Publication Data

US 2004/0126152 A1 Jul. 1, 2004

(30) Foreign Application Priority Data

Sep. 24, 2002 (JP) ..... 2002-278184

(51) Int. Cl.[7] ..... G03G 15/01
(52) U.S. Cl. ..... 399/302; 347/131
(58) Field of Search ..... 399/302, 72; 347/254, 347/131

(56) References Cited

U.S. PATENT DOCUMENTS

| | | | | |
|---|---|---|---|---|
| 6,091,922 | A | 7/2000 | Bisaiji | 399/297 |
| 6,212,351 | B1 * | 4/2001 | Kawagoe et al. | 399/302 |
| 6,259,879 | B1 | 7/2001 | Bisaiji | 399/296 |
| 6,434,354 | B2 | 8/2002 | Bisaiji | 399/296 |
| 2001/0007616 | A1 | 7/2001 | Bisaiji | 399/296 |

FOREIGN PATENT DOCUMENTS

| | | |
|---|---|---|
| JP | 6-317992 | 11/1994 |
| JP | 11-52758 | 2/1999 |
| JP | 11-249459 | 9/1999 |

OTHER PUBLICATIONS

U.S. Appl. No. 10/661,589, filed Sep. 15, 2003, Iida et al., pending.

* cited by examiner

*Primary Examiner*—Susan Lee
(74) *Attorney, Agent, or Firm*—Fitzpatrick, Cella, Harper & Scinto

(57) ABSTRACT

The image forming apparatus includes a movable first image bearing member on which a toner image is formed, and a movable second image bearing member which is brought into contact with the first image bearing member and to which the toner image on the first image bearing member is transferred, in which a dot-shaped dot image formed of a toner different from the toner image is formable on the first image bearing member, and in which a distance between dot centers of the dot images is equal to or smaller than a width of a contact part between the first image bearing member and the second image bearing member in a moving direction of the first image bearing member. Consequently, it is possible to steadily suppress an image streak occurrence and to obtain a final image having a high quality in a stable manner.

13 Claims, 6 Drawing Sheets

IMAGE FORMING APPARATUS INCLUDING TWO IMAGE FORMING MEMBERS AND FEATURING A DOT-SHAPED IMAGE

BACKGROUND OF THE INVENTION

1. Field of the Invention

The present invention relates to an image forming apparatus such as a copying machine or a printer for transferring onto a recording material a toner image formed on an image bearing member using, for instance, an electrophotographic process and subsequently fixing the toner image to form a permanent image on the recording material.

2. Related Background Art

Up to now, as color image forming apparatuses capable of outputting a full color image, apparatuses having the following structure have been put in practical use. That is, at a first transferring area formed in an abutting part between an image bearing member surface and an intermediate transferring body surface, a first transferring bias is applied to a first transferring member disposed on a rear side of the intermediate transferring body to temporarily transfer onto the intermediate transferring body surface a toner image on the image bearing member surface (hereinafter, referred to as "primary transfer"). After that, a transferring material passes through a second transferring area formed at a contact part between the intermediate transferring body and a second transferring member to apply a second transferring bias thereto, so that the toner image on the intermediate transferring body surface is transferred again onto the transferring material (hereinafter, referred to as "secondary transfer").

FIG. 9 shows an example of the color image forming apparatus having the above structure. Now, referring to FIG. 9, a description will be given of an operation of the image forming apparatus having the above structure.

In the image forming apparatus of this example, image exposure using a laser beam L is applied from an exposure apparatus 103 through a reflection mirror 104 onto a rotation drum type electrophotographic photosensitive member (hereinafter, referred to as "photosensitive drum") 101 as the image bearing member rotating in a direction of an arrow R1, which is uniformly charged by a charger 102. Then, latent images corresponding to target color images are respectively formed on an exposure area A.

Next, the latent images are developed by a developing devices 105 (yellow developing device 105Y, magenta developing device 105M, cyan developing device 105C, and black developing device 105Bk) to thereby form an yellow toner image, a magenta toner image, a cyan toner image, and a black toner image on the photosensitive drum 101, respectively. The yellow toner image, the magenta toner image, the cyan toner image, and the black toner image are superposed in order on a surface of an intermediate transferring belt 106 at a primary transferring nip part B as a primary transferring area between a primary transferring roller 107 and the photosensitive drum 101 and primarily transferred thereonto. This primary transfer was carried out while the intermediate transferring belt 106 makes four rotations in a direction of an arrow R2. The toner images of full color thus superposed on the intermediate transferring belt 106 are collectively secondarily transferred as the full color toner image corresponding to a target color image onto a transferring material P fed to a secondary transferring nip part C as a secondary transferring area between a secondary transferring roller 108 and a secondary-transferring opposing roller 106*b*. The transferring material P, after undergoing the secondary transfer, is transported to a fixing device 115 where the toners of four colors are melted for color mixture by applying a pressure and heat thereto and fixed onto the transferring material P. Thus, a full-color final image is formed on the transferring material P.

After the above process is completed, a secondary transfer residual toner on the intermediate transferring belt 106 is removed by an intermediate transferring belt cleaner 109. In addition, a primary transfer residual toner on the photosensitive drum 101 is collected by a cleaner 110 and used for a subsequent cycle. Note that in such an image forming apparatus, a laser beam scanning direction is called a main scanning direction (direction perpendicular to a direction in which the photosensitive drum moves), whereas the directions of the arrows R1 and R2 in which the photosensitive drum 101 and the intermediate transferring belt 106 move, respectively are each called a sub-scanning direction. For the purpose of further improving an image quality of a final image obtained by the above image forming apparatus, however, the inventors of the present invention have made various studies on the image forming apparatus of such a type and found that, upon primarily transferring the toner image formed on the photosensitive drum 101 surface onto the intermediate transferring belt 106 surface, an abrupt rotation variation of the photosensitive drum 101 may occur, which causes an exposure unevenness of the laser exposure L. This leads subsequently to an image streak occurring on the toner image formed on the photosensitive drum 101 surface.

To cope with such a problem, dot-shaped toner images are additionally formed on the photosensitive drum 101 in addition to the toner image of an image pattern that a user demands, so that the photosensitive drum 101 surface and the intermediate transferring belt 106 surface at the intermediate transferring nip part B surface are made smooth to each other to thereby avoid the exposure unevenness resulting from the rotation variation, which is presumed to achieve an effect to a certain degree.

For example, in an image forming apparatus disclosed in Japanese Patent Application Laid-Open No. H11-52758, minute dot toner images are formed on the photosensitive drum through a uniform dispersion to prevent a color drift from occurring on the toner image primarily transferred onto the intermediate transferring belt. By using the dot toner image, the same protection effect may be supposedly exerted on the image streak resulting from the exposure unevenness as well.

However, there remains to be solved a problem that a sufficient effect cannot be obtained in some cases depending on an arrangement of the additionally formed dot toner images.

For example, the dot toner images disclosed in Japanese Patent Application Laid-Open No. H11-52758 are formed at such a low density that about 3 to 10 dots are formed per unit area of 1 $cm^2$. More specifically, according to Japanese Patent Application Laid-Open No. H11-52758, it is unsure whether or not the dot toner image is always within the primary transferring nip part. In particular, if the dot toner images are arranged in the sub-scanning direction at a larger distance, it is conceivable that no dot toner image is intervened in the primary transferring nip part at a certain timing during printing. Under such situations, the image streak cannot be stably prevented from occurring in every image pattern that the user demands.

SUMMARY OF THE INVENTION

An object of the present invention is to provide an image forming apparatus capable of steadily suppressing an image streak occurrence and obtaining a final image having a high image quality in a stable manner.

Another object of the present invention is to provide an image forming apparatus including: a movable first image bearing member on which a toner image is formed; and a movable second image bearing member which is brought into contact with the first image bearing member and to which the toner image on the first image bearing member is transferred, in which a dot-shaped dot image formed of a toner different from the toner image is formable on the first image bearing member, and in which a distance between dot centers of the dot images is equal to or smaller than a width of a contact part between the first image bearing member and the second image bearing member in a moving direction of the first image bearing member.

Further objects of the present invention will be apparent upon reading the following description.

DESCRIPTION OF THE PREFERRED EMBODIMENTS

Hereinafter, an image forming apparatus according to the present invention will be described with reference to the accompanying drawings.

Figure 1:
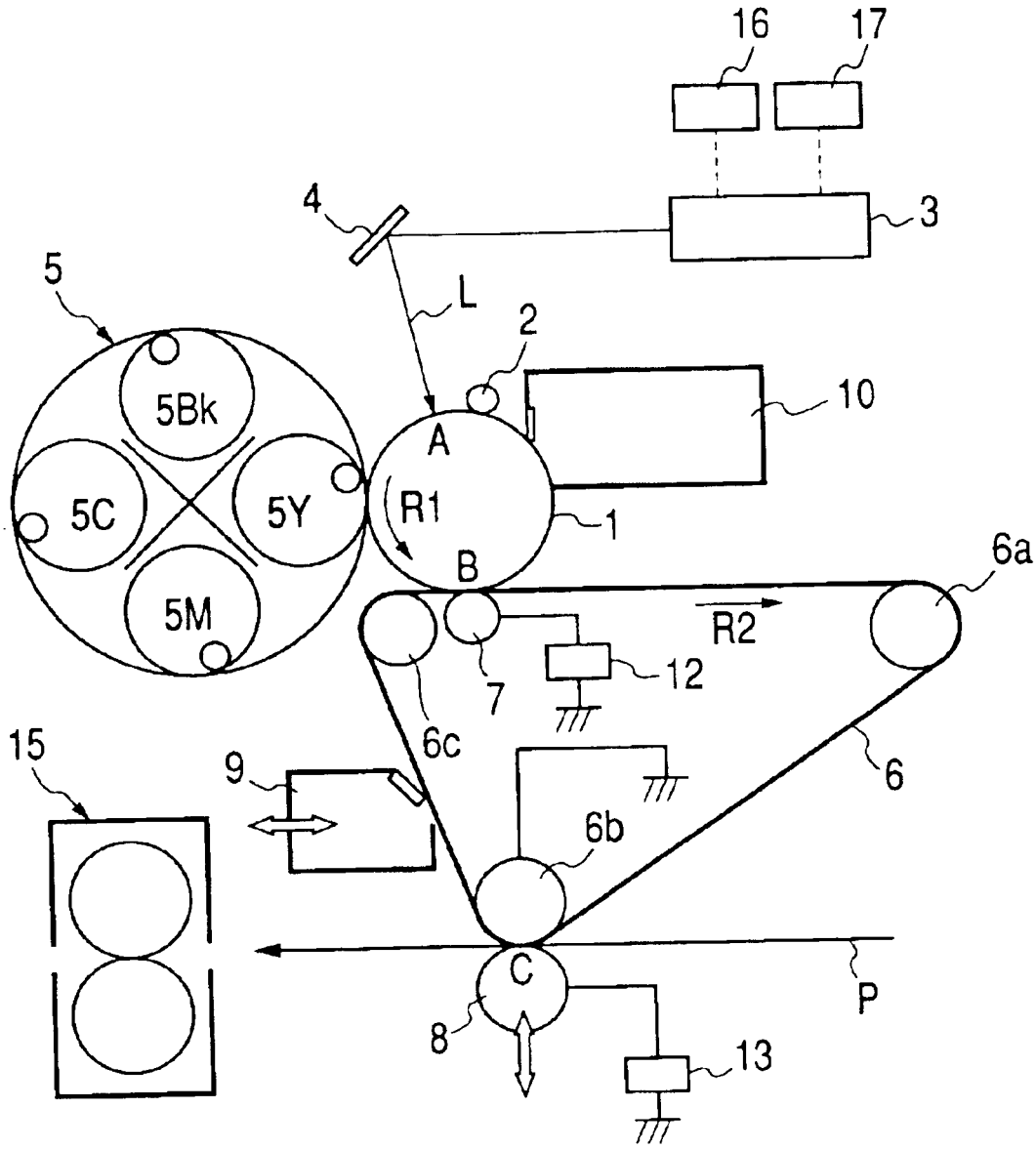
FIG. 1 shows an image forming apparatus according to an embodiment of the present invention.

The present invention can be embodied in an image forming apparatus such as a laser printer of an electrophotographic process shown in FIG. 1. A description will be given of an entire structure of the image forming apparatus according to an embodiment of the present invention below.

In the image forming apparatus according to this embodiment, image exposure using a laser beam L is applied from an exposure apparatus 3 through a reflection mirror 4 onto a rotation drum type electrophotographic photosensitive member (hereinafter, referred to as "photosensitive drum") 1 as a first image bearing member rotating in a direction of an arrow R1, which is uniformly charged by a charger 2. Then, latent images corresponding to target color images are respectively formed on an exposure area A.

Next, the latent images are developed by a developing device 5 (yellow developing device 5Y, magenta developing device 5M, cyan developing device 5C, and black developing device 5Bk) to thereby form an yellow toner image, a magenta toner image, a cyan toner image, and a black toner image on the photosensitive drum 1, respectively. The yellow toner image, the magenta toner image, the cyan toner image, and the black toner image are superposed in order on a surface of an intermediate transferring belt 6 as a second image bearing member at a primary transferring nip part B as a primary transferring area between a primary transferring roller 7 and the photosensitive drum 1 executed a primary transfer thereonto. This primary transfer was carried out while the intermediate transferring belt 6 makes four rotations (revolutions) in a direction of an arrow R2. The toner images of full color thus superposed on the intermediate transferring belt 6 are integrally secondarily transferred as the full color toner image corresponding to a target color image onto a transferring material P fed to a secondary transferring nip part C as a secondary transferring area between a secondary transferring roller 8 and a secondary-transferring opposing roller 6*b*. The transferring material P, after undergoing the secondary transfer, is transported to a fixing device 15 where the toners of four colors are melted for color mixture by applying a pressure and heat thereto and fixed onto the transferring material P. Thus, a full-color final image is formed on the transferring material P. Note that, the intermediate transferring belt 6 is interposed between the photosensitive drum 1 and the primary transferring roller 7 at the primary transferring nip part B and is brought into contact with the photosensitive drum 1.

The intermediate transferring belt 6 is stretched by a driving roller 6*a*, the secondary-transferring opposing roller 6*b*, and a tension roller 6*c* and rotates in the direction of the arrow R2 through the rotation of the driving roller 6*a*. The driving roller 6*a* is composed of a core metal on which a surface layer made of a rubber material is formed. Also, the intermediate transferring belt 6 used is a resin- or rubber-made seamless belt. Note that in such an image forming apparatus, a laser beam scanning direction is called a main scanning direction (direction perpendicular to a direction in which the photosensitive drum moves), whereas the directions of the arrows R1 and R2 in which the photosensitive drum 1 and the intermediate transferring belt 6 move (rotate), respectively are each called a sub-scanning direction.

Next, the above primary and secondary transferring processes will be described.

If the photosensitive drum 1 is an OPC photosensitive member of a negative polarity, for instance, the toner of the negative polarity is used for a case where an exposure part on the photosensitive drum 1 after the image exposure L is subjected to the development using the developing device 5 (yellow developing device 5Y, magenta developing device 5M, cyan developing device 5C, or black developing device 5Bk). Accordingly, a transferring bias of a positive polarity is applied from a transfer high-voltage power supply 12 to the primary transferring roller 7 as a first transferring member. Upon the secondary transfer using the secondary transferring roller 8 as a second transferring member, the secondary-transferring opposing roller 6*b* with the rear side being grounded or with the appropriate bias being applied thereto is set as an opposing electrode. In this state, the positive-polarity bias is applied from the high-voltage power supply 13 to the secondary transferring roller 8. Thus, the roller is brought into contact therewith from the rear side of the transferring material P.

After the above process is completed, a secondary transfer residual toner on the intermediate transferring belt 6 is removed by an intermediate transferring belt cleaner 9. In addition, a primary transfer residual toner on the photosensitive drum 1 is collected by a cleaner 10 and used for a subsequent cycle.

In this embodiment, a process speed is set to 117 mm/sec in the image forming apparatus shown in FIG. 1.

Note that in this embodiment, the photosensitive drum 1 as the first image bearing member is composed of an aluminum cylinder on which an ordinary electrophotographic photosensitive layer formed of polycarbonate is formed, with a diameter of 50 mm. The intermediate transferring belt 6 as the second image bearing member is a single-layer seamless resin belt with a thickness of 75 μm, which is formed of polyimide after resistivity adjustment through a carbon dispersion. A volume resistivity ρv is $10^9$ Ωcm at the time of applying a voltage of 100V. The primary transferring roller 7 is formed of conductive urethane foam in which an ion conductive agent is molecular-dispersed. A foam layer is formed with a thickness of 4 mm on an SUS core metal having a diameter of 8 mm and an outer diameter thereof is 16 mm. From a calculation based on a relation with a current measured under the conditions that a load of 4.9 N is applied to both ends, the roller is rotated at a peripheral velocity of 50 mm/sec with respect to a rotational aluminum cylinder that is grounded, and the core metal thereof is applied with the voltage of 100 V, a resistivity is $5\times10^6$ Ω. Regarding the primary transferring roller 7, its own weight is 160 g. The primary transferring roller 7 is brought into contact with the photosensitive drum 1 through the intermediate transferring belt 6 by means of a spring applying 500 gf (4.9N) to both the ends, thus forming the primary transferring nip part B.

The inventors of the present invention have made various experiments on the above image forming apparatus using the photosensitive drum and the intermediate transferring belt and evaluated an image obtained by the above image forming apparatus. As a result, as also described above, it is found that any image streak may occur in the toner image primarily transferred onto the intermediate transferring belt surface, which causes the deteriorated final image quality.

<Regarding a Cause of Generating the Image Streak>

As is apparent from additional studies by the inventors of the present invention, the foregoing image streak occurs due to an abrupt variation in peripheral velocity of the photosensitive drum and the intermediate transferring belt. In particular, it is found that the abrupt variation and the image streak occur by the following causes.

Figure 2:
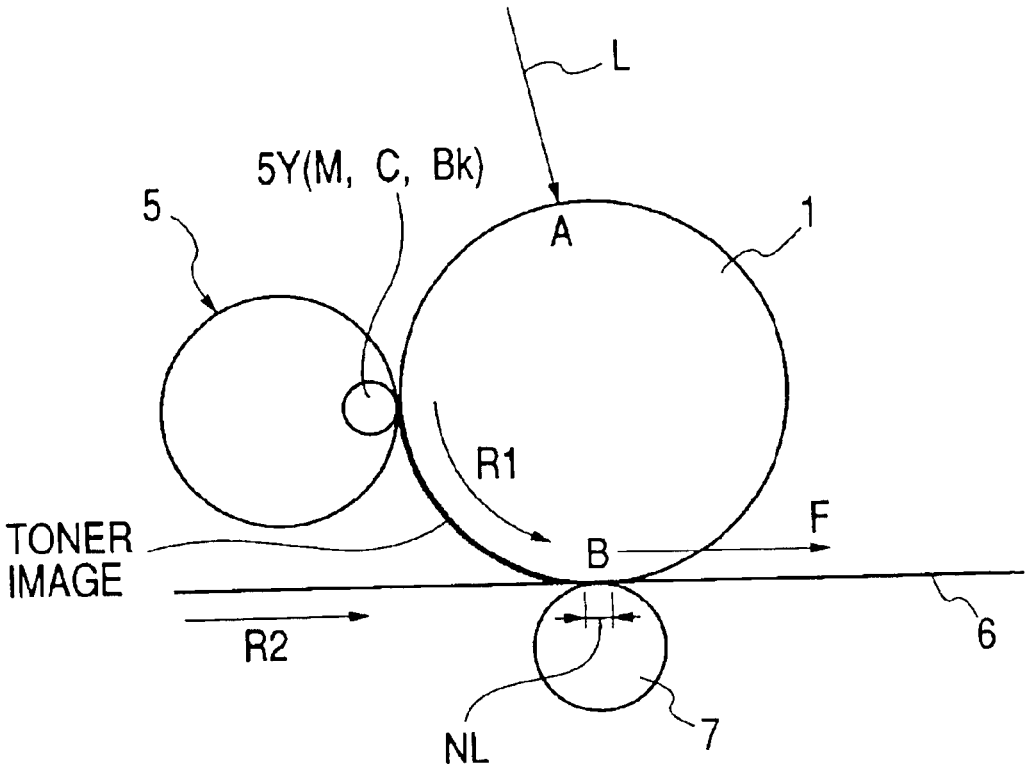
FIG. 2 is an enlarged view showing vicinities of a primary transferring part.

FIG. 2 is an enlarged view showing vicinities of the primary transferring part of the image forming apparatus of this embodiment. The intermediate transferring belt 6 is rotated in the direction of the arrow R2 at a surface peripheral velocity which is about 0.5% higher than that of the photosensitive drum 1 rotated in the direction of the arrow R1 during printing. That is, the photosensitive drum 1 and the intermediate transferring belt 6 differ in moving velocity at the contact part (primary transferring nip part B). This is because, as disclosed, for example, in Japanese Patent Application Laid-Open Nos. H11-249459 and H06-317992, the transfer is performed utilizing such a shear force as to wipe the toner image out of the photosensitive drum 1, so that a transferring efficiency upon the primary transfer is improved and a "hollow" line or character image is prevented.

Figure 3:
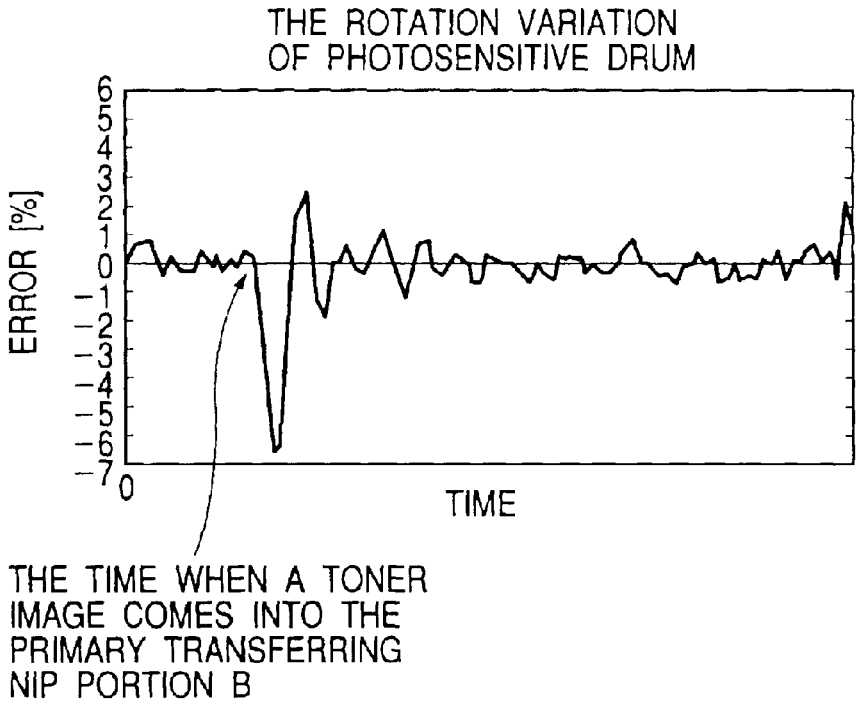
FIG. 3 shows a rotation variation of a photosensitive drum.

Under such circumstances, if the toner is not within the primary transferring nip part B, on the photosensitive drum 1 surface, a frictional force F acts tangentially (in the sub-scanning direction) from the intermediate transferring belt 6 surface toward a downstream side thereof. However, when a leading end of the toner image developed onto the photosensitive drum 1 comes into the primary transferring nip part B, the frictional force F abruptly decreases down to almost 0. This is because the toner is supplied into the primary transferring nip part B, so that the photosensitive drum 1 surface and the intermediate transferring belt 6 surface are made smooth to each other. Therefore, as shown in FIG. 3, the sudden rotation variation occurs on the photosensitive drum 1 and hence, the laser exposure L is applied to the photosensitive drum 1 surface with any writing unevenness, which leads subsequently to the image streak in the main scanning direction on the toner image formed on the photosensitive drum 1 surface. This image streak appears also on the final image.

Figure 4:
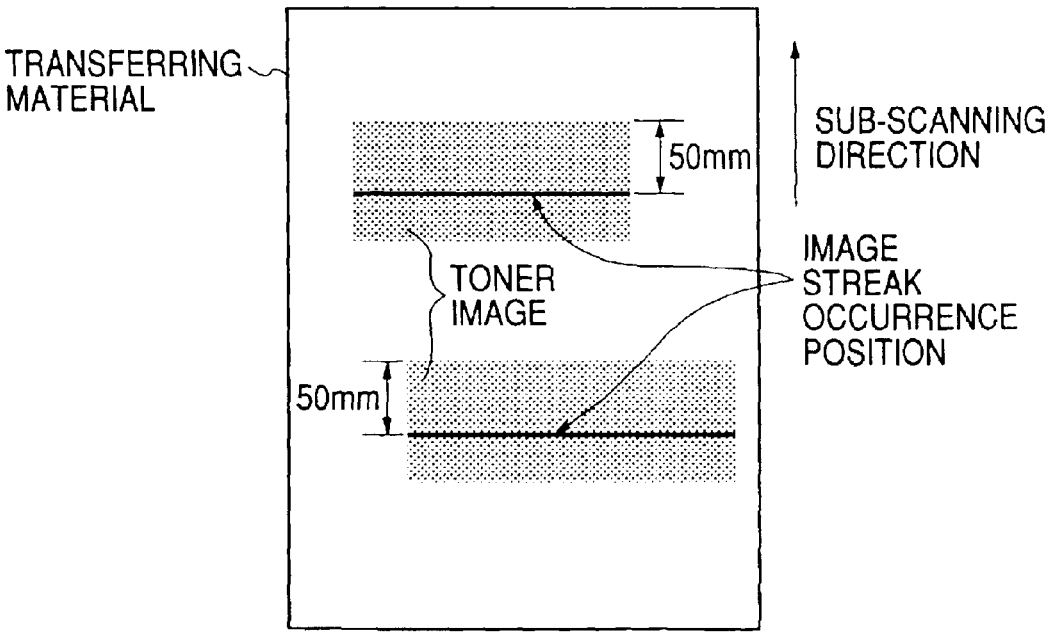
FIG. 4 shows an image streak on a transferring material outputted from the image forming apparatus.

Note that, as shown in FIG. 4, in the final image formed on the transferring material, such an image streak appears on the toner images arranged in the image pattern, at a position of about 50 mm below a top of each toner image in the sub-scanning direction (on the downstream side thereof), which corresponds to a distance between the laser exposure part A and the primary transferring part B. In particular, the image streak conspicuously appears in the case where a halftone toner image portion easily affected by the laser exposure unevenness is at the above position.

As described above, the above frictional force F involves the variation with time intermittently according to the image pattern that the user demands, with the result that the image streak occurs on the final image due to the rotation variation of the photosensitive drum 1.

<Regarding the Additional Formation of the Dot Toner Image>

As is understood from the above, provided that the frictional force F between the photosensitive drum 1 and the intermediate transferring belt 6 at the primary transferring nip part B can be reduced in advance, even when the leading end of the toner image comes into the primary transferring nip part B, the rotation variation of the photosensitive drum 1 can be suppressed. Hence, it is possible to avoid the occurrence of such an image streak as to degrade the image quality.

In the image forming apparatus of this embodiment, based on the above proviso, at the primary transferring nip part B where the toner image on the photosensitive drum 1 is transferred onto the intermediate transferring belt 6, another toner different from the toner image is intervened in advance to impart the smoothness to the photosensitive drum 1 surface and the intermediate transferring belt 6 surface, thereby reducing the frictional force to prevent the image streak from occurring. This is realized as follows. That is, an additional toner image (dot image formed of the toner) according to information different from that of the image pattern that the user demands as the final image, i.e., the image pattern corresponding to image data of each color outputted from an image processing unit 16 is intervened at the primary transferring nip part B together with the above toner image.

Note that if the additional toner image based on the additional information is formed at the primary transferring nip part B, the additional toner image is finally transferred onto the transferring material P as well. As a result, depending on an image condition of the additional toner image, the final image is damaged by the additional toner image and the image quality thereof is considerably degraded. To cope therewith, in the image forming apparatus of this embodiment, using dot toner image forming means as described below, minute dot toner images (dot images formed of the toner) invisible to the user's eyes are formed on the photosensitive drum 1 surface, with a size of 1 pixel (42 μm×42 μm) or approximately several pixels that are adjacent to each other.

Also, upon the formation of the above dot toner image on the photosensitive drum 1, an appropriate average printing ratio varies among the image forming apparatuses depending on a contact force of the primary transferring roller 7 to the photosensitive drum 1, the difference of the peripheral velocity between the photosensitive drum 1 surface and the intermediate transferring belt 6 surface, and the like. In the image forming apparatus of this embodiment, however, the toner is superposed in an amount of about 0.05 to 1% to that of the superposed toner at a solid image portion of each color on the photosensitive drum 1.

<Regarding an Arrangement of the Dot Toner Images>

Incidentally, to assure the satisfactory image quality free of the image streak in a stable manner for all the image patterns that the user demands, the above dot toner images formed by the dot toner image forming means has to comply with the following conditions as well as should be formed through the pattern formation having a specific arrangement.

(Condition 1)

Provided that a distance between dot centers of the dot toner images within the pattern in the sub-scanning direction is DI (mm), and a width of the contact part where the photosensitive drum 1 and the intermediate transferring belt 6 contact each other in the sub-scanning direction (nip width in the sub-scanning direction of the primary transferring nip part B formed by the photosensitive drum 1 and the primary transferring roller 7 through the intermediate transferring belt 6) is NL (mm), a relationship of DI (mm)≦NL (mm) is satisfied in every region within the pattern. In other words, in the moving direction of the photosensitive drum 1, the distance between the dot centers of the dot toner images is always equal to or smaller than the width of the contact part between the photosensitive drum 1 and the intermediate transferring belt 6 throughout the dot toner images.

Here, the dot distance DI (mm) in the sub-scanning direction is also defined as a length of total blank region containing no dot in the sub-scanning direction, in the entire width in the main scanning direction or as a dot distance in the sub-scanning direction when at least one dot image comes into the primary transferring nip part B.

By forming such a pattern, the dot toner image can be steadily intervened in the primary transferring nip part B during the image formation, making it possible to assure the satisfactory image quality free of the image streak in a stable manner for all the images.

In contrast, if the pattern that does not meet the above conditions is formed, a timing at which no dot toner image is intervened in the primary transferring nip part B is caused. As a result, in the case where the leading end of the toner image comes into the primary transferring nip part B at such a timing, the above image streak occurs.

Figure 5:
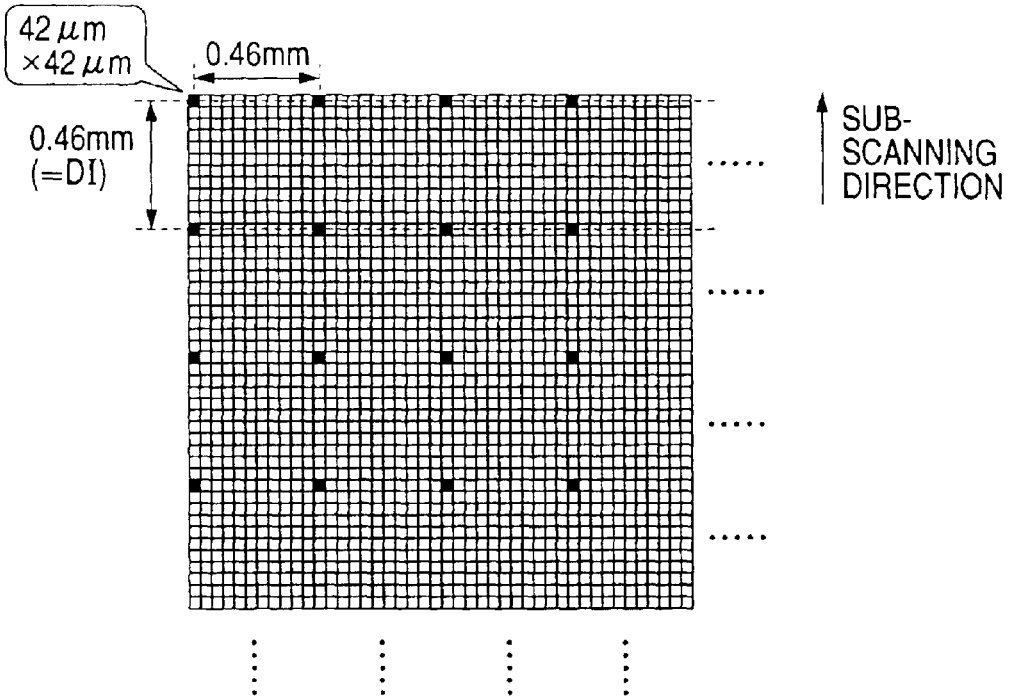
FIG. 5 shows a dot image.
Figure 6:
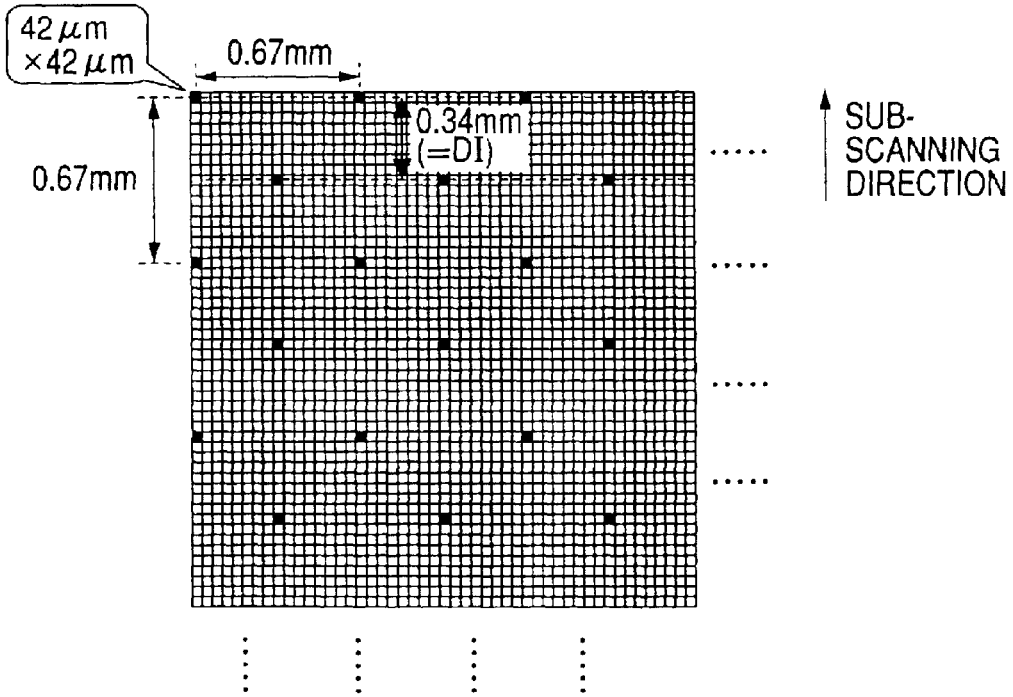
FIG. 6 shows another dot image.

Here, in the image forming apparatus of this embodiment, considering that the nip width NL in the sub-scanning direction at the primary transferring nip proton B is 1 mm, a dot toner image pattern shown in FIGS. 5 and 6 is formed as the dot toner image pattern meeting Condition 1 above. Note that in the figures, 1 block corresponds to 1 pixel (42 $\mu$m×42 $\mu$m). The data of solid black pixels in the figures is set to FFh (maximum level), so that the minute dot toner images are formed at those positions.

In the dot toner image pattern having the dots dispersed therein shown in FIG. 5, the dot toner images each having a size of 1 pixel are arranged at a distance of 0.46 mm in the main and sub-scanning directions, respectively. The dot distance in the sub-scanning direction is as follows: DI=0.46 mm. Also, in FIG. 6, the dot toner images of the same size are arranged at 45 degrees to the main scanning direction and the dot distance in the sub-scanning direction is as follows: DI=0.34 mm.

The toner images in either pattern are formed while overlapping with the entire region of the toner images of the image pattern that the user demands.

<Regarding an Embodiment Mode of the Dot Toner Image Additional Formation>

Incidentally, the foregoing dot toner image can be formed on the photosensitive drum 1 surface in various modes and transferred onto the intermediate transferring belt 6 surface.

In the image forming apparatus of this embodiment, when a toner image of a first color is set as an yellow toner image and formed on the photosensitive drum 1, the above-mentioned dot toner image independent of the image information of this toner image is formed simultaneously on the photosensitive drum 1 with the yellow toner. Thus, the yellow toner image and the dot toner image are primarily transferred to an image region of the intermediate transferring belt 6 together by the action of the primary transferring roller 7 applied with the transferring bias.

In this case, the image data of the first color processed by the image processing unit 16 in the image forming apparatus of this embodiment is used together with the data for the dot toner image formed by a dot toner image forming unit 17. Based on the data, an ON/OFF control is performed on the image exposure using the laser beam L emitted from an exposure apparatus 3. Accordingly, on the photosensitive drum 1, electrostatic latent images for the toner image of the first color and the dot toner image are formed together, which are visualized as the toner image with the yellow toner by the yellow developing device and primarily transferred onto the intermediate transferring belt 6. Note that the dot toner image forming means is composed of the dot toner image forming unit 17, the exposure apparatus 3, the photosensitive drum 1, the charger 2, the yellow developing device 5Y, and the like.

The data for the dot toner image is controlled such that the dot toner image is within at least the primary transferring nip part B while the electrostatic latent image for the toner image of the first color is formed by the laser beam exposure. That is, the leading end of the dot toner image comes before the leading end of the toner image of the first color (on the downstream side in the moving direction of the photosensitive drum). A trailing end of the dot toner image may pass through the primary transferring nip part after the completion of the exposure for the formation of the electrostatic latent image for the toner image of the first color. However, as in this embodiment, it is preferable that the trailing end of the dot toner image comes after that of the toner image of the first color (on the upstream side in the moving direction of the photosensitive drum).

Through the above arrangement, at the time when the yellow toner image on the photosensitive drum 1 is primarily transferred onto the intermediate transferring belt 6, the dot toner image is intervened at the primary transferring nip part B. Thus, the image streak is prevented from occurring on the yellow toner image. In addition, when the toner images of a second color and its subsequent colors are formed on the photosensitive drum 1 with a magenta toner, a cyan toner, and a black toner and primarily transferred onto the intermediate transferring belt 6, the dot toner image with the yellow toner, which has been already held on the intermediate transferring belt 6, is intervened at the primary transferring nip part B. Accordingly, the image streak is prevented from occurring on the toner image of each color as well.

Also, although the dot toner image additionally formed independently of the image information that the user demands is secondarily transferred onto the transferring material in the end, in the image forming apparatus of this embodiment, the image is formed with the yellow toner and thus, inconspicuous. Thus, it is possible to avoid the undesirable degradation of the final image quality.

As has been described in this embodiment, the dot toner image pattern is formed in which the relationship of DI (mm)≦NL (mm) is satisfied, provided that the distance between the dot toner images independent of predetermined image information within the pattern in the sub-scanning direction is DI (mm), and the width of the contact part formed between the photosensitive drum 1 and the intermediate transferring belt 6 in the sub-scanning direction is NL (mm). Further, the dot toner image with the first-color toner is steadily intervened in the primary transferring nip part, so that the foregoing image streak is stably prevented from occurring on the toner image primarily transferred onto the intermediate transferring belt 6 surface.

In addition, the additionally formed dot toner image is also transferred to the image region on the intermediate transferring belt 6 subjected to the primary transfer of the toner image, and finally transferred and fixed onto the transferring material. However, each dot toner image has a minute size and is formed with the yellow toner and hence, can be made inconspicuous and generally invisible with the user's eyes. In such a way, it is possible to avoid the degradation of the predetermined toner image quality.

(Embodiment 2)

This embodiment provides another example of the dot toner image as described in Embodiment 1 above. A structure of the image forming apparatus or the like is the same as in Embodiment 1.

The dot toner images described in Embodiment 1 can be arbitrarily dispersed and formed on the photosensitive drum 1 surface and the intermediate transferring belt 6 surface as long as the foregoing pattern that meets Condition 1 is formed. A feature of this embodiment is that the dot toner image formed of the yellow toner constitutes a pattern indicating tracking information of the image forming apparatus, e.g., information on a production number, manufacturer, production date, etc., of the image forming apparatus while meeting Condition 1.

Figure 7:
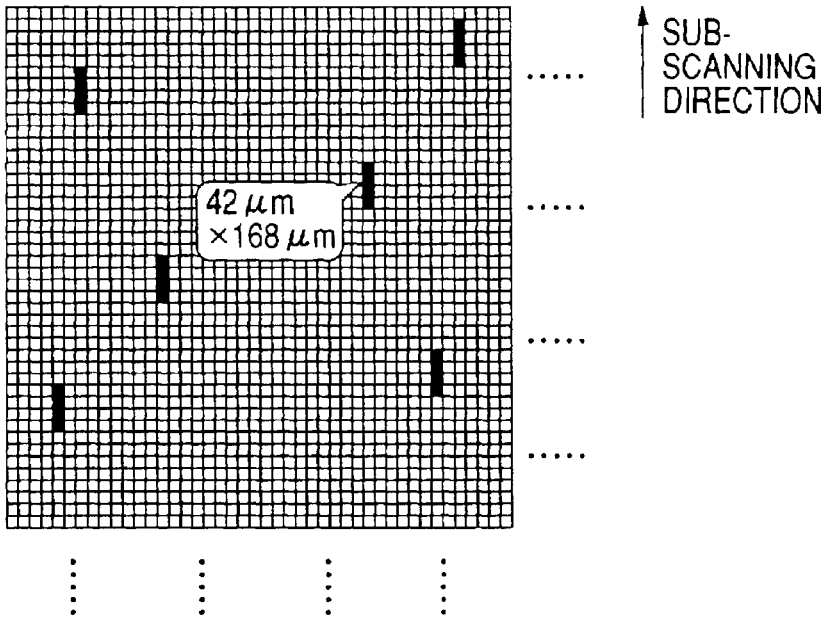
FIG. 7 shows another dot image.

FIG. 7 shows an example of the dot toner image pattern. In the figure, 1 block corresponds to 1 pixel (42 μm×42 μm). The data of solid black pixels in the figure is set to FFh, so that the minute dot toner images are formed at those positions. In the pattern of this embodiment, the dot toner image having a size of 1 (main scanning direction) ×4 (sub-scanning direction) pixels constitutes the pattern indicating the tracking information of the image forming apparatus while meeting Condition 1. Also, the dot toner image is formed while overlapping with the entire region of the toner image of the image pattern of bill, portfolio, etc.

With such a structure, while the image streak occurrence is avoided, when the bill or the portfolio is counterfeited using the image forming apparatus, the dot size or arrangement of the dot toner images formed on the counterfeit is investigated to thereby specify the image forming apparatus. In such a way, it is possible to contribute to an anticounterfeit measure as for the counterfeit bill or portfolio.

(Embodiment 3)

This embodiment provides another example of the dot toner images as described in Embodiments 1 and 2 above. A structure of the image forming apparatus or the like is the same as in Embodiments 1 and 2.

The dot toner image of the pattern indicating the tracking information of the image forming apparatus used for preventing the counterfeit bill or portfolio as described in Embodiment 2 may be switchable in setting of the ON or OFF state for each image forming apparatus. A feature of this embodiment is that the dot toner image formed of the yellow toner constitutes a pattern (dispersed dot images) which can be distinguished from the pattern of the dot toner image formed of the same yellow toner and indicating the tracking information while meeting Condition 1.

Figure 8:
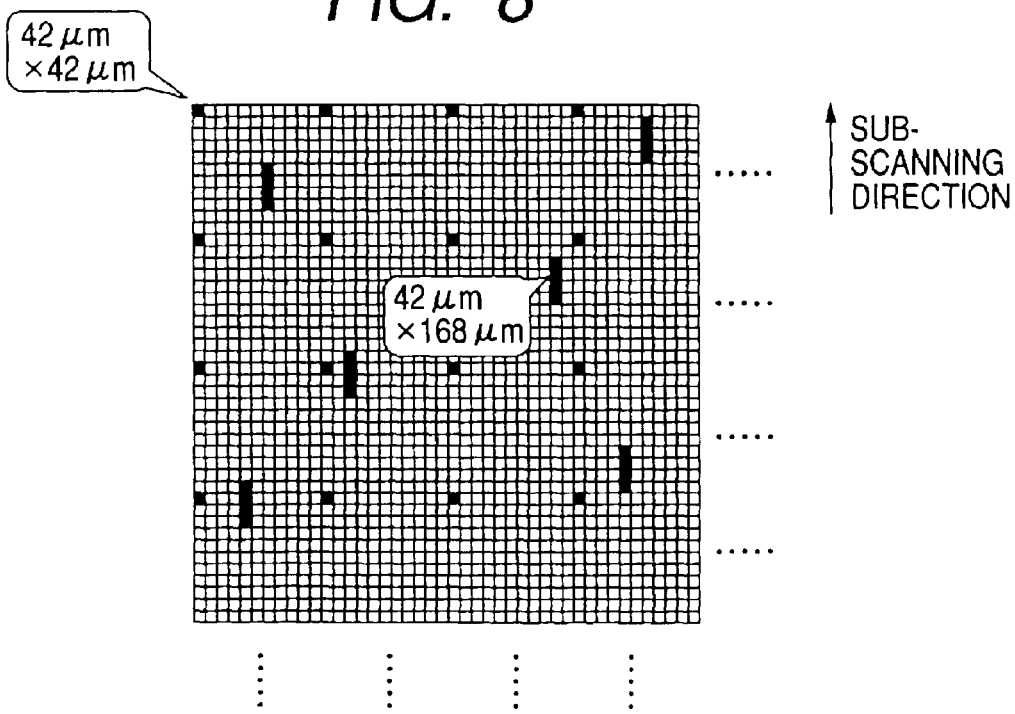
FIG. 8 shows another dot image.
Figure 9:
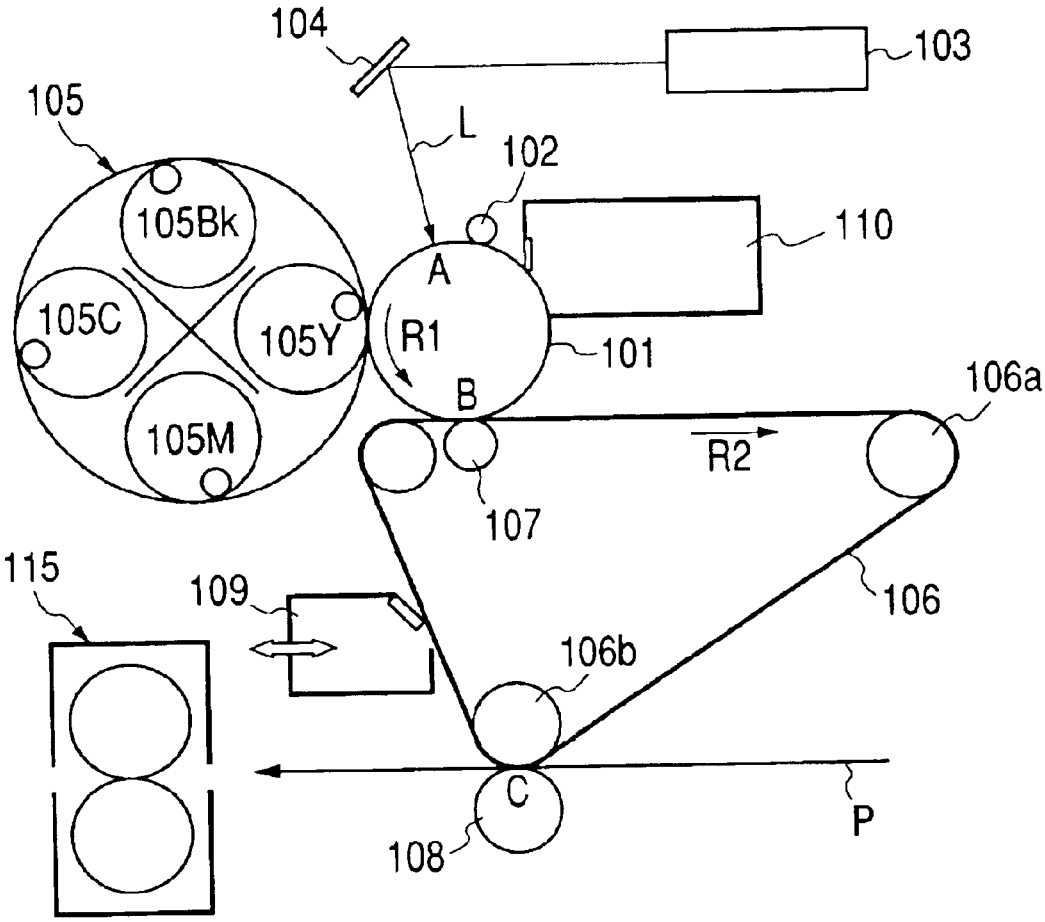
FIG. 9 shows a conventional image forming apparatus.

FIG. 8 shows an example of the dot toner image pattern and a state where this dot toner image pattern and the dot toner image pattern indicating the tracking information are formed in a mixed manner. In the figure, 1 block corresponds to 1 pixel (42 μm×42 μm). The data of solid black pixels in the figure is set to FFh, so that the minute dot toner images are formed at those positions. In the pattern of this embodiment, the dot toner image constitutes a pattern that can be distinguished from the dot toner image pattern indicating the tracking information with a size of 1 (main scanning direction) ×4 (sub-scanning direction) pixels according to a dot size or arrangement difference while meeting Condition 1. Also, this dot toner image is formed while overlapping with the entire region of the toner image of the image pattern of the bill, portfolio, etc.

With such a structure, in the case of setting the dot toner image indicating the tracking information in an OFF state, this dot toner image solely serves to avoid the image streak occurrence. On the other hand, in the case of setting the dot toner image indicating the tracking information in an ON state, while this dot toner image and the dot toner image indicating the tracking information serve to avoid the image streak occurrence in the mixed manner, when the bill or the portfolio is counterfeited using the image forming apparatus, the dot toner image indicating the tracking information formed on the counterfeit is extracted and the dot size or arrangement thereof is investigated to thereby specify the image forming apparatus. In such a way, it is possible to contribute to the anticounterfeit measure as for the counterfeit bill or portfolio.

The dot toner additional formation according to the present invention is not limited to a transferring system of the image forming apparatus of any of Embodiments 1 to 3 above but is applicable to transferring systems of any mode in the image forming apparatuses of any mode. The embodiments of the present invention have been explained so far, but the present invention is by no means limited to those embodiments and any modification is allowable without departing from a technical concept of the present invention.

What is claimed is:

1. An image forming apparatus comprising:

a movable first image bearing member on which a toner image is formed; and a movable second image bearing member which comes into contact with said first image bearing member and to which the toner image on said first image bearing member is transferred, wherein the toner image on said second image bearing member is transferred onto a transferring material, and the transferring material displays the toner image;

wherein a dot image pattern which is formed of dot toner images using a toner different from the toner image is formable on said first image bearing member, and wherein a distance between dot centers of the dot toner images is equal to or smaller than a width of a contact part between said first image bearing member and said second image bearing member in a moving direction of said first image bearing member.

2. An image forming apparatus according to claim 1, wherein the distance between the dot centers of the dot toner images is steadily equal to or smaller than the width of said contact part between said first image bearing member and said second image bearing member in the moving direction of said first image bearing member throughout the dot image pattern.

3. An image forming apparatus according to claim 1, wherein in the moving direction of said first image bearing member, a leading end of the dot image pattern is on a downstream side of a leading end of the toner image and a trailing end of the dot image pattern is on an upstream side of a trailing end of the toner image.

4. An image forming apparatus according to claim 1, wherein the dot image pattern is formed of a yellow toner.

5. An image forming apparatus according to claim 1, wherein the toner image is formed corresponding to each color of a plurality of colors and the dot image pattern is formed while being superposed on a first color toner image formed on said first image bearing member.

6. An image forming apparatus according to claim 1, wherein the dot toner images have a pattern indicating information of the image forming apparatus.

7. An image forming apparatus according to claim 6, wherein the dot toner images have a dispersed dot image pattern independently of said pattern indicating information of the image forming apparatus.

8. An image forming apparatus according to claim 1, wherein said first image bearing member and said second image bearing member differ in a moving speed at the contact part.

9. An image forming apparatus according to claim 1, wherein said first image bearing member comprises a photosensitive member and said second image bearing member comprises an intermediate transferring member.

10. An image forming apparatus according to claim 1, further comprising a transferring member forming a nip part with said first image bearing member through said second image bearing member, wherein the width of said contact part between said first image bearing member and said second image bearing member corresponds to a width of the nip part.

11. An image forming apparatus according to claim 1, wherein the dot image pattern is formed according to information different from information for forming the toner image which a user demands.

12. An image forming apparatus according to claim 1, wherein the transferring material does not display substantially the dot toner images.

13. An image forming apparatus according to claim 1, wherein the dot toner images are invisible to a user.

* * * * *

UNITED STATES PATENT AND TRADEMARK OFFICE

CERTIFICATE OF CORRECTION

PATENT NO. : 6,947,695 B2
DATED : September 20, 2005
INVENTOR(S) : Kenichi Iida et al.

It is certified that error appears in the above-identified patent and that said Letters Patent is hereby corrected as shown below:

Column 1,
Line 46, “by a” should read -- by --; and
Line 50, “an” should read -- a --.

Column 3,
Line 59, “an” should read -- a --.

Column 7,
Line 11, “has” should read -- have --.
Line 12, “as well as” should read -- and, furthermore, they --; and
Line 49, “proton” should read -- portion --.

Column 8,
Line 6, “an” should read -- a --.

Column 9,
Line 20, “with” should read -- to --.

Signed and Sealed this

Fourteenth Day of March, 2006

JON W. DUDAS
*Director of the United States Patent and Trademark Office*